United States Patent [19]

Robbio

[11] 4,104,870

[45] Aug. 8, 1978

[54] LINK-MAKING MACHINE AND METHOD

[76] Inventor: Albert Robbio, 16 Fyffe Ave., Cranston, R.I. 02920

[21] Appl. No.: 688,350

[22] Filed: May 20, 1976

[51] Int. Cl.[2] ..... B21L 7/00

[52] U.S. Cl. ..... 59/20

[58] Field of Search ..... 59/20, 16, 1, 10, 12, 59/21, 22, 26, 27, 35; 140/88; 72/168

[56] References Cited

U.S. PATENT DOCUMENTS

| | | | |
|---|---|---|---|
| 329,010 | 10/1885 | Busey | 59/20 |
| 367,923 | 8/1887 | Peck | 59/16 |
| 534,410 | 2/1895 | Stubble | 59/20 |

FOREIGN PATENT DOCUMENTS

| | | | |
|---|---|---|---|
| 603,818 | 1/1926 | France | 59/20 |

*Primary Examiner*—C.W. Lanham
*Assistant Examiner*—Gene P. Crosby
*Attorney, Agent, or Firm*—Joseph H. Killion

[57] ABSTRACT

An improved link-making machine is described which comprises a frame and a mandrel mounted on the frame outwardly directed from the frame and arranged to receive the wire thereon. Means to form the wire are located adjacent the wire and disposed to receive the wire and to direct the wire around the mandrel to form a plurality of loops thereon, the outermost of which is positioned toward one end of the mandrel and characterized by an open eccentric end portion. Means to provide wire are adapted to the frame and positioned to direct the wire upon the means to form the wire and includes a power source and means to move the wire connected to the power source and activated by the power source to move the wire from a first position to a second position closer to the means to form, the distance between the two positions substantially corresponding to that length of wire required for one link. Means to close the outermost loop to form the link are located to move between a position distant from the outermost eccentric loop to a position in contact with the outermost eccentric loop to close the outermost eccentric loop. Finally a cutter adapted to the frame and joined to the means to close the outermost eccentric loop before the loop is cut comprises a power source and a blade member connected to the power source which is activated to move between an open position distant the mandrel to a closed position close to the mandrel to cut the link from the wire.

11 Claims, 6 Drawing Figures

LINK-MAKING MACHINE AND METHOD

BACKGROUND OF THE INVENTION

Presently available machines for forming links and placing a finding thereon have a number of significant disadvantages. For example, a typical commercial link-making operation involves a four or five step operation including some or all of the following steps:

1. pre-shaping and cutting of a link-blank;
2. forming a reservoir of pre-shaped link-blanks;
3. opening of the link-blank;
4. attaching the desired finding thereon;
5. closing, shaping and sealing of the link-blank.

This operation is inefficient and costly both from the viewpoint of the number, size and cost of the necessary machinery and from the viewpoint of the operator's efficiency and time involved.

Another major disadvantage of present practice involves the safety factor. A standard component of present machinery is a "closing-jaw" which compresses the link-blank to form the link, after a finding has been attached. The majority of these machines require the operator to manually position a finding, such as a locket, on the link-blank and hold it while the "closing-jaw" closes the link-blank. An inadvertant or hasty action on the part of the operator may result in the severe mangling or crushing of a finger.

Finally, it is not possible to produce a circular link on present machinery.

There is a need for a safer, more efficient machine and method for producing links, including circular links and links with findings thereon.

SUMMARY OF THE INVENTION

My invention relates to machinery for the manufacture of links with or without findings thereon, to the method of manufacturing such links and to the links manufactured thereby.

I have discovered an improved link-making machine for forming links from a wire which comprises a frame and a mandrel mounted on the frame outwardly directed from said frame and arranged to receive the wire thereon. Means to form the wire are adapted to the frame adjacent to the mandrel and disposed to receive the wire and to direct the wire around the mandrel to form a plurality of elliptical loops thereon, the outermost of which is positioned toward one end of the mandrel and characterized by an open eccentric end-portion. Means to provide a wire are adapted to the frame and positioned to direct the wire upon the means to form the wire and comprise a power source and means to move the wire connected to the power source and activated by the power source to move the wire from a first position to a second position closer to the means to form, the distance between the positions substantially corresponding to that length of wire required for one link. Means to close the outermost, eccentric loop to form a link are adapted to the frame and arranged to move between a position distant from the outermost eccentric loop to a position in contact with the outermost eccentric loop of the wire to close the outermost eccentric loop to form the link. A cutter is adapted to the frame and joined to the means to close the outermost eccentric loop so that the outermost eccentric loop is closed before the link is cut from the wire and comprises a power source and a blade-member connected to the power source and activated thereby to move between an open position distant from the mandrel to a closed position close to the mandrel to cut the link from the wire.

My link-making machine permits the manufacture of links from a strand, such as a wire.

My method comprises feeding a wire from which the chain links are to be manufactured to a forming area. The wire is then wrapped about a forming mandrel in the forming area to form a plurality of spout loops of the wire about the mandrel with the outermost loop politioned toward one end of the mandrel and characterized by an axial loop with an eccentric open end portion. The outermost loop is then cut from the wire and the remaining loops and the wire is then wrapped about the other end of the forming mandrel to form a spaced replacement loop on the mandrel and these steps are repeated to manufacture a plurality of closed links from the wire.

The strand, particularly wire, can be of any of a number of materials. A metal wire is preferred to make links, particularly of a "half-hard" wire, due to its lack of resilient spring-back and low cost.

The frame for my machine must be sturdy and stable. While materials such as plastic or aluminum might be used, I prefer to use a steel frame having sufficient thickness and weight to give stability to my machine.

My machine uses a base-member, particularly a mandrel, serves as the form around which the strand is looped. While this mandrel may be permanently affixed to the frame, I prefer a detachable mandrel. I prefer a detachable mandrel which allows the user of my machine, by replacing the mandrel to manufacture links not only of different sizes, as for example those links having an outside diameter of $\frac{1}{4}$ or $\frac{1}{2}$ inch, but also of different shapes, for example elliptical or circular.

This means to form the strand will be described in the preferred embodiment wherein a pair of forming fingers are used, however it is recognized that other means such as described in the alternative embodiment may be employed for the same purpose.

The means to provide a strand to the means to form will be described in the preferred embodiment wherein an intermittant drive roller/feeder roller system is utilized to provide an amount of strand necessary for the formation of a new link as each link is manufactured and displaced from the mandrel. Other means to perform this function may be utilized.

The means to close the outermost eccentric loop to form the link will be described in the preferred embodiment. It is recognized that whereas a spring loaded closing arm is used other means such as a compression member with a solid closing surface may be used. Optionally as shown in an alternative embodiment or "stripper pin" may be used to aid in the release of the completed link from the mandrel. It is preferred that the closing of the outermost eccentric loop take place prior to the cutting of said portion from the strand.

The cutter will be described also in the preferred embodiment wherein a cutter which moves along slide mounts is described.

It is recognized that alternative cutters such as a circular cutter or 9 inches pin cutter may be employed. Additionally, it is preferred to use a "by-pass cutter," or a cutter which does not directly contact the surface of the mandrel in contrast to an "anvil-cutter" which cuts and contacts the surface of the mandrel, for the reason that the "by-pass cutter" does not cause as much wear and tear on the mandrel as does the "anvil-cutter."

In the preferred embodiment the structure to coordinate the timing and cooperation of the means to cose and the means to cut will be described. A vertically mobile unit connecting the means to cut and the spring-loaded closing arm coordinate their respective actions by a cam arm with a timing surface.

My invention uses a single power source for this mechanical operations but it is recognized that separate power sources and/or timing devices can be utilized to perform these functions.

The preferred embodiment will show the use of compressed air as the power source to run the entire machine. Compressed air is a most economical power source, if a manufacturer has sufficient business to justify an in-house air-compressor. Small manufacturers, however, will prefer electrically driven machinery. It is then within the spirit and scope of the invention to utilize an electric rather than a compressed air power source.

One advantage of my invention is that the size of the link can be changed as for example from ¼ to ½ inch by merely changing the mandrel. Present machinery requires different dies and mating units or, in fact, a different machine for each link size necessary.

My invention is advantageous in that it produces the links from a wire directly and does not require a reservoir of link-blanks.

My invention has the further advantage that it can make circular as well as elliptical links.

My invention has the further advantage that is is basically a two-step process as compared to the four or five step processes presently used. This results in economy and speed and efficiency compared to the current machinery.

My invention has the further utility and unforseen advantage that it can be used to just make links, in addition to its utility with regard to making links with findings attached.

My invention has the additional advantage of being a safer machine than those presently available since it requires that the hands and feet of the operator be employed away from the cutter when it is being used.

Another advantage of my invention is the rapid manufacture of circular links which are currently virtually unobtainable on a production basis.

The construction designed to carry out these and other advantages of the present invention will hereinafter be described together with other features thereof.

DETAILED DESCRIPTION OF THE DRAWINGS

Figure 1:
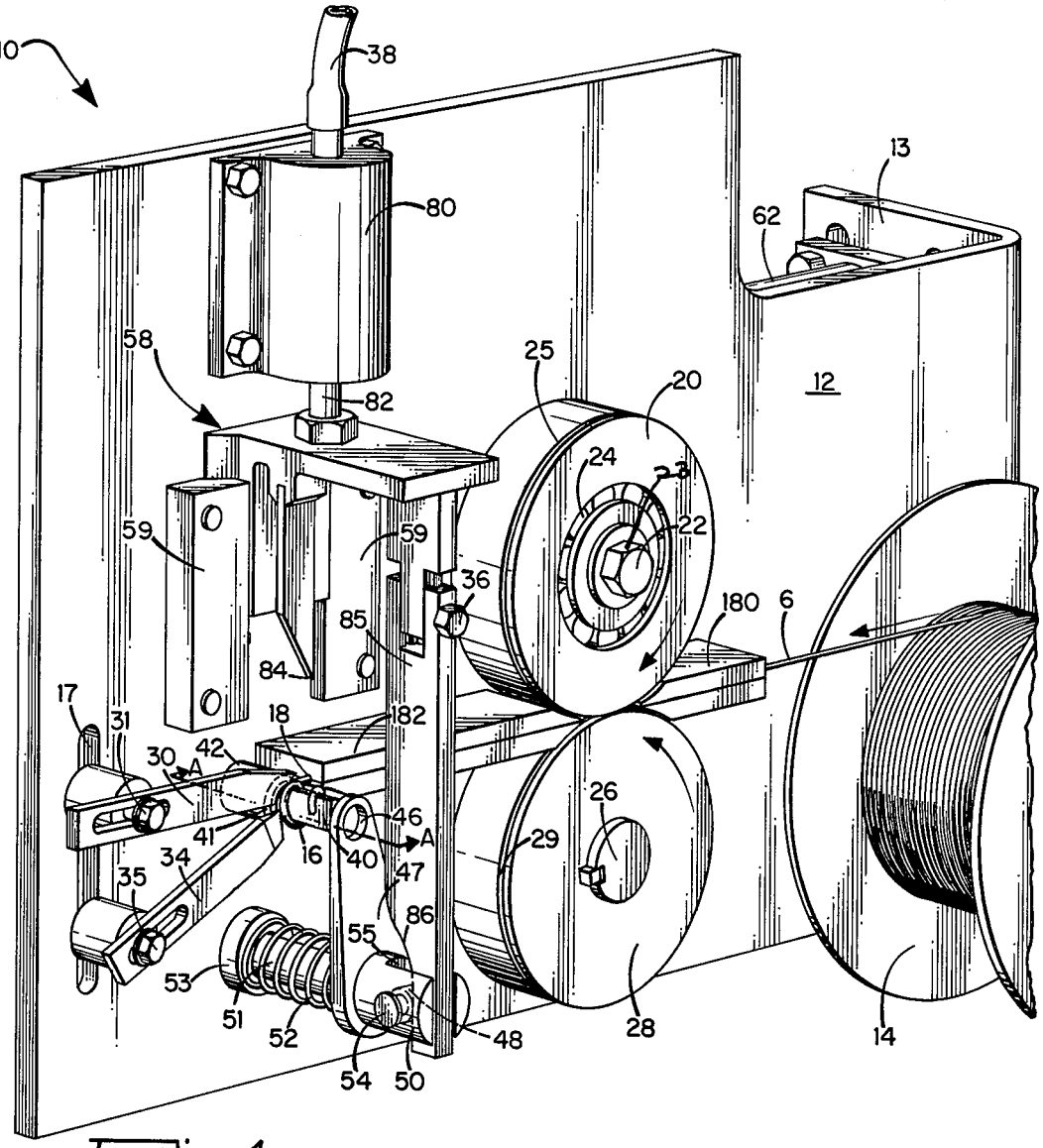
FIG. 1 is a perspective, partially fragmented frontal view of my machine with the cutter and closing arm in the "open" position.

Referring now in particular to the accompanying drawings, an example of the improved link-forming machine comprising my invention is generally indicated in FIG. 1 at 10 and includes a frame 12 having right angle wall 13. A spool 14 containing wire 6 feeds the wire through paired blocks 180,182 forming wire path 18.

The wire contacts an intermittent feed system including free-rolling roller 20 having roller bearing 24 and gripping surface 25, which rotates on axel 22 mounted thereon by locking nut 23. A drive roller 28 having gripping surface 29 fotates on axel 26.

Figure 1A:
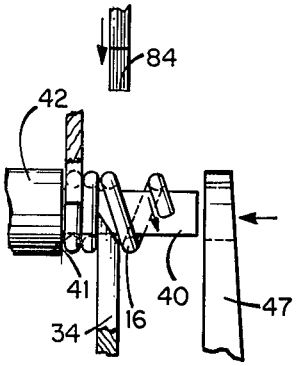
FIG. 1A is a cross-sectional view of the mandrel area of my machine, taken along axis A—A of FIG. 1 showing the imparting of an open eccentricity to the outermost loop of wire and the travel path of the cutter and closing arm from their "open" to their "closed" positions.

After passing through the feed system the wire contacts forming finger 30 mounted in vertically adjustable mounting slot 17 and having adjustable mounting screw 31. The wire forms a loop around detachable mandrel 40 having mandrel shoulder 41 and mandrel end- portion 42. After several loops are formed around the mandrel the outermost loop contacts forming finger 34 mounted in vertically adjustable mounting slot 17 and having adjustable mounting screw 35. The wire turns to form an open eccentric loop adjacent the outermost portion of the mandrel (FIG. 1A).

The mechanical action can be stopped at this point and a finding can be affixed to the open eccentric link.

The machine is then activated. Compressed air feeds through air tube power source 38 into air cylinder 80 deflecting piston 82 in a downward direction. Vertically moving unit 58 affixed to the piston, descends along guiding blocks 59 from an "open" position distant the mandrel towards the mandrel.

Cutter 84 is affixed to said vertically moving unit and also moves from an "open" position towards the mandrel.

Spring-loaded closing arm 47 defines hole 46 and is mounted on stem 51 having stem-guide 53. Spring 52 encircles the stem.

Figure 1B:
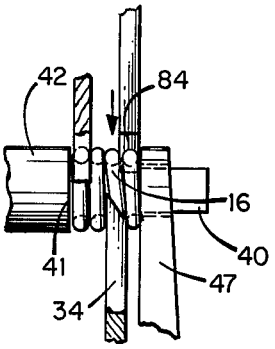
FIG. 1B is the same view showing the cutter and the closing arm in the "closed" positions.

Cam arm 85, vertically adjustable by adjustment screw 36 is connected at one end to said vertically moving unit and on the other end has a cam surface 86 which contacts roller-cam 54 as the vertically moving unit descends and displaces the roller-cam inwardly along roller slot 55 to move the spring-load ed closing arm from an "open" position inwardly toward the mandrel. The vertical adjustment and the design of the cam surface is coordinated to permit the spring-loaded closing arm to contact the outermost loop and to close it before the cutter severs the completeed link from the wire. At the "closed" position (FIG. 1B), the outermost eccentric loop is compressed by the spring-loaded closing arm against the other loops and the closing finger 34; the cutter has slightly by-passed the top of the flat surface of the mandrel and cut the link from the wire; and the cam surface now contacts the air valve control 48, activates it and begins to reverse the path of travel. The vertically moving unit pulls the spring-loaded closing arm away from the mandrel and starts the cutter along its return path of travel to the "open" position.

Figure 3:
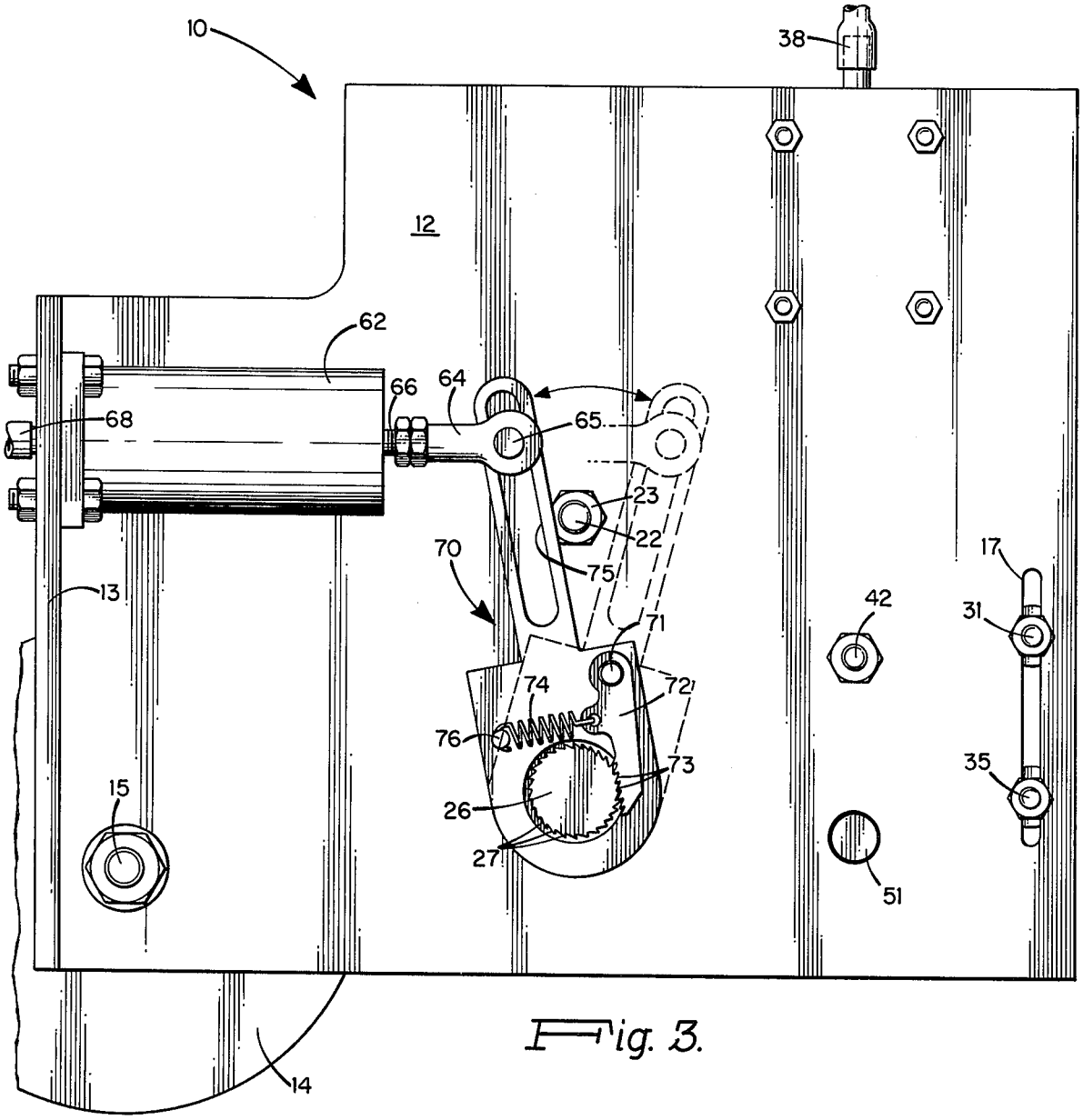
FIG. 3 is a perspective partially-outlined rear view of my machine showing the intermittant drive mechanism and the path of travel of the ratchet arm.

At this point the intermittent feed system, shown in FIG. 3, is activated by feeding compressed air into air cylinder 62 by air tube power source 68, displacing piston rod 66 from a first to a second position. The piston rod is adjustably affixed to yoke-arm 64 at point 66. The drive actuator cam arm assembly indicated generally at 70 is slidingly adapted to the yoke arm by pin 65 riding in slot 75. As the drive actuator cam arm is displaced from the first towards the second position thereof, a cam craw 72 having retaining spring 76 and which is moveably mounted on pivot pin 71 and which further has a multiplicity of ratchet teeth 73, engages the gripping grooves 27 on axel 36 moving the drive roller and feeding the wire a distance substantially equal to one link towards the mandrel. This wire forces a replacement loop around the mandrel for the link just cut off and further aids in the release of the previous link by pushing it off the mandrel. In the preferred embodiment both tubes 38 and 68 are connected to the same power source. It is within the scope of the invention to utilize separate power sources, either electrical or compressed air, or a combination thereof, for these assemblies.

The displacement of the formed link is further aided by the expansion of the remaining loops on the mandrel when the spring-loaded closing arm retracts.

In FIG. 3 also is depicted axel 15 of the spool of wire.

Figure 2:
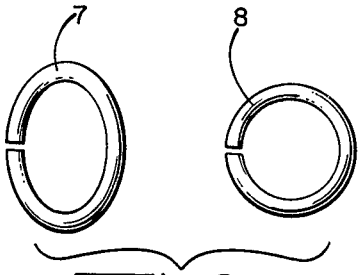
FIG. 2 is a perspective view of typical links made by this machine.

FIG. 2 shows a round link 8 and an ellyptical link 7 made by this machine and process.

Figure 4:
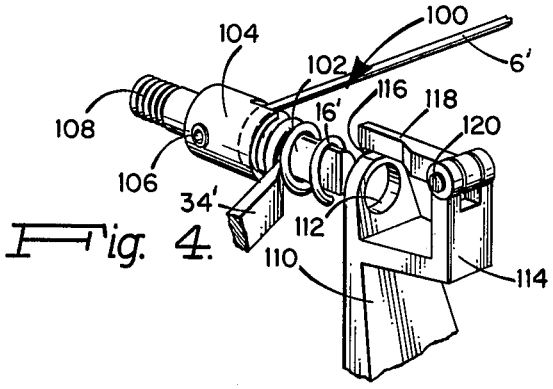
FIG. 4 is a perspective alternative view of the mandrel and closing arm assembly.

FIG. 4 shows an alternative embodiment of the mandrel and closing arm. Screw-threaded end 108 of mandrel 102 mounts into the frame. The wire 6' contacts forming collar 104 which has set screw 106 and which acts as a coil-forming surface to direct the wire around the mandrel forming loops 16' and off forming finger 34' which turns the wire to form an outermost eccentric loop.

Alternate closing arm 110 defines hole 112 and has arm 114 forming an extension thereof which ends in extractor beam 118 joining the closing arm at pivot pin 120 and including extractor claw 116 to grasp the completed link and facilitate removal from the mandrel.

A typical use of the machine is in the jewelry trade to make links with a finding, such as a chain or a locket attached thereto. After several loops are formed around the mandrel the operator places the finding on the outermost eccentric loop, activates the machine, and both closes the loop to form the link and severs the link from the remaining loops and wire. The process is then repeated.

A two-stage machine can be utilized here with even greater advantage. In this case with two of my machines (one the mirror image of the other) side by side different findings can be positioned at either end of a single chain.

Although the invention has been described in considerable detail such description is for the purpose of illustration only and should not be construed as limiting the invention.

What I claim is:

1. A device for forming links from a wire comprising:

(a) a frame;

(b) a first power source associated with said frame;

(c) a mandrel mounted on the frame outwardly directed from the frame and arranged to receive the wire thereon;

(d) means to form the wire adapted to the frame adjacent the mandrel, disposed to receive the wire and to direct the wire around the mandrel to form a plurality of loops thereon, the outermost of which is positioned toward one end of the mandrel and characterized by an open eccentric end portion;

(e) means to provide wire connected to said first power source, adapted to the frame and positioned to direct the wire upon the means to form the wire; and activated by said power source to move the wire from a first position to a second position closer to the means to form the distance between the positions substantially corresponding to that length of wire required for one link;

(f) means to close the outermost eccentric loop to form a link arranged to move between a position distant from the outermost eccentric loop to a position in contact with outermost eccentric loop to close the outermost eccentric loop;

(g) a cutter connected to a second power source adapted to the frame and joined to the means to close the outermost eccentric loop which is closed before the link is cut from the wire having a blade-member connected to the power source and activated thereby to move between an open position distant from the mandrel to a closed position close to the mandrel to cut the link from the wire.

2. A link-making device as in claim 1 wherein the means to provide wire to said mandrel comprises:

(a) a pair of rollers, one of which is a drive roller and one of which is a follow roller;

(b) a means for driving said rollers to provide wire intermittantly to said mandrel in an amount sufficient to form a replacement loop about said mandrel.

3. The link-making device as in claim 2 wherein the means to move the wire comprises:

(a) an adjustable yoke-arm connected to and powered by said first power source moveable axially from a first position of said yoke-arm along an axis to a second position of said yoke-arm;

(b) a ratchet arm connected to said yoke-arm cooperating with said yoke-arm from said first position of said yoke-arm to said second position of said yoke-arm;

(c) a plurality of ratchet cams, affixed at one end to said ratchet arm and on the other end engaged to an axel of said drive roller, having a configuration tapered to grip said axel and to rotate said drive roller as said yoke-arm moves from the first position of said yoke-arm to the second position of said yoke-arm and to release the surface of said axel as said yoke-arm moves axially from the second position of said yoke-arm back to the first position of said yoke-arm.

4. The link-making device as in claim 2 wherein the drive roller further comprises:

(a) an outer surface thereof roughened to provide traction in moving said wire.

5. A link-making device as in claim 1 wherein the means for forming said wire around said mandrel comprises:

(a) one adjustable guiding member attached to said frame located adjacent said mandrel, positioned to receive said wire and to direct said wire around said mandrel to form a plurality of loops thereon.

6. A link-making device as in claim 5 further comprising:

(a) a second guiding member attached to said frame located adjacent the outermost end of said mandrel disposed to turn said wire forming a substantially eccentric open loop at said outermost end of said mandrel.

7. A link-making device as in claim 1 wherein the means to close the substantially eccentric open loop comprises:

(a) a closing arm mounted on said frame adapted to move from a first position of said closing arm distant from said substantially eccentric open loop along an axis to a second position of said closing arm contacting and closing said substantially open eccentric loop and to move axially from said second position of said closing arm to said first position of said closing arm.

(b) means to axially displace said closing arm from said first position of said closing arm to said second position of said closing arm.

8. An apparatus as in claim 7 wherein said means to axially displace said closing arm comprises:

(a) a spring means adapted to cooperate with said closing arm to move axially said closing arm from said second position of said closing arm to said first position of said closing arm when depressed and when expanded from said second position of said closing arm to said first position of said closing arm.

9. An apparatus for manufacturing links as in claim 1 wherein said means to cut said closed loop comprises:

(a) a cutter slidingly mounted on said frame moveable from a first position of said cutter away from said mandrel along an axis to a second position adjacent said mandrel, cutting said link from said wire.

10. An apparatus as in claim 9 further comprising:

(a) a closing pin located adjacent said closing arm;

(b) a cam arm therefore on one end to said closing arm and at the other end with said cutter, moveable in an axis from a first position of said cam arm, depressing said closing pin and moving said closing arm from said first position of said closing arm to said second position of said closing arm, to the second position of said cam arm at which point, the cutter cuts the link from the wire and said cam arm then moves from the second position of said cam arm to the first position of said cam arm disengaging said closing pin, releasing said closing arm to return from the second position of said closing arm to the first position of said closing arm, and returning said cutter to the first position of said cutter.

11. An apparatus for manufacturing links from wire comprising:

(a) a frame;

(b) a mandrel detachably mounted on the frame outwardly directed from the frame and arranged to receive the wire thereon;

(c) means to form the wire adapted to the frame adjacent the mandrel, disposed to receive the wire and to direct the wire around the mandrel to form a plurality of loops thereon, the outermost of which is positioned toward one end of the mandrel and characterized by an open eccentric end portion, comprising:

(i) one adjustable guiding member attached to said frame located adjacent said mandrel, positioned to receive said wire and to direct said wire around said mandrel to form a plurality of loops thereon.

(ii) a second guiding member attached to said frame located adjacent the outermost end of said mandrel disposed to turn said wire forming a substantially eccentric open loop at said outermost end of said mandrel.

(d) Means to provide wire adapted to the frame and positioned to direct the wire upon the means to form the wire, comprising:

(i) a power source;

(ii) a pair of rollers, one of which is a drive roller and one of which is a follow roller;

(iii) an adjustable yoke-arm connected to and powered by said power source moveable axially from a first position of said yoke-arm along an axis to a second position of said yoke-arm;

(iiii) a ratchet arm connected to said yoke-arm cooperating with said yoke-arm from said first position of said yoke-arm to said second position of said yoke-arm;

(iiiii) a plurality of ratchet cams, affixed at one end to said ratchet arm and on the other end engaged to an axel of said drive roller, having a configuration tapered to grip said axel and to rotate said drive roller as said yoke-arm moves from the first position of said yoke-arm to the second position of said yoke-arm and to release the surface of said axel as said yoke-arm moves axially from the second position of said yoke-arm back to the first position of said yoke-arm.

(e) means to close the outermost eccentric loop to form a link and arranged to move between a position (e) distant from the outermost eccentric loop to a position in contact with outermost eccentric loop to close the outermost eccentric loop, comprising:

(i) a closing arm mounted on said frame adapted to move from a a first position of said closing arm distant from said substantially eccentric open loop along an axis to a second position of said closing arm contacting and closing said substantially open eccentric loop and to move axially from said second position of said closing arm to said first position of said closing arm.

(ii) a spring means adapted to cooperate with said closing arm to move axially said closing arm from said first position of said closing arm to said second position of said closing arm when depressed and when expanded from said second position of said closing arm to said first position of said closing arm;

(f) a cutter and joined to the means to close the outermost eccentric loop which is closed before the link is cut from the wire;

(g) a cam arm associated on one end with said spring-loaded closing arm and at the other end with said cutter, moveable in an axis from a first position of said cam arm, depressing a closing pin and moving said spring-loaded closing arm from said first position of said closing arm to said second position of said closing arm, to the second position of said cam arm at which point, the cutter cuts the link from the wire and said cam arm then moves from the second position of said cam arm to the first position of said cam arm disengaging said closing pin, releasing said spring-loaded closing arm to return from the second position of said spring-loaded closing arm to the first position of said spring-loaded closing arm, and returning said cutter to the first position of said cutter.

* * * * *